United States Patent [19]

Kawaguchi

[11] Patent Number: 4,651,943

[45] Date of Patent: Mar. 24, 1987

[54] SPOOL FOR CORRECTION TAPE ASSEMBLY

[75] Inventor: Kiyoshi Kawaguchi, Amagasaki, Japan

[73] Assignees: Hiroaki Watanabe; Kagakushi Kogyo Co., Ltd., both of Japan

[21] Appl. No.: 798,977

[22] Filed: Nov. 18, 1985

[30] Foreign Application Priority Data

Nov. 20, 1984 [JP] Japan ..... 59-176383

[51] Int. Cl.[4] ..... B65H 16/02

[52] U.S. Cl. ..... 242/68.3; 242/68.5; 400/697

[58] Field of Search ..... 242/68.3, 68.1, 68.5; 400/242–246, 697, 697.1

[56] References Cited

U.S. PATENT DOCUMENTS

| | | | |
|---|---|---|---|
| 2,142,582 | 1/1939 | Wright | 242/68.3 |
| 2,381,535 | 8/1945 | Gemmel | 242/68.3 |
| 2,755,037 | 7/1956 | Sarah | 242/68.3 |
| 3,313,561 | 4/1967 | Kirilouckas | 242/68.3 X |
| 3,851,833 | 12/1974 | Jackson | 242/68.3 |
| 4,518,128 | 5/1985 | Watanabe | 242/71.8 |

*Primary Examiner*—John M. Jillions

*Attorney, Agent, or Firm*—Thomas L. Tully

[57] ABSTRACT

A spool for a reversible-type correction tape assembly comprising a cap and a spool shaft and improved releasable fastening means therebetween. The spool shaft is adapted to receive a correction ribbon-winding core axially-slideable, but not rotatable around the axis thereof. The spool shaft comprises a sleeve having a top cap-receiving section which has an outer cap-engaging surface which receives a cap detachably mounted thereon so that the winding core does not slip off of the spool shaft. The cap has a depending wall having an inner shaft-engaging surface for engaging the cap-engaging surface of the spool shaft. The engaging surface of the cap or of the spool shaft is provided with a projection extending in a radial direction, and the other engaging surface is provided with a recess or hole capable of receiving the projection. The portion of the engaging surface having the projection or the portion having the recess or hole is capable of being bent or flexed when the cap is twisted to release the engagement between the projection and the recess or hole so that the cap can be lifted off of the spool shaft. The cap cannot be released when only an axial cap-pulling force is added. The cap can be easily detached by twisting but is securely fastened against loosening during use.

10 Claims, 10 Drawing Figures

SPOOL FOR CORRECTION TAPE ASSEMBLY

BACKGROUND OF THE INVENTION

The present invention relates to a spool for a correction tape assembly. More particularly, it relates to a spool adapted to be used in a winding side of a correction tape assembly which can be used one or more time (hereinafter referred to as a spool for reversible-type correction tape assembly).

Generally, a correction tape for a typewriter will have ink stuck to its lift-off surface only once, and it will be considered to be no longer suitable for further use. Therefore, a conventional correction tape assembly is designed in a suitable structure for only one use. For example, such a type of correction tape assembly includes a dispensing core to be set onto a dispensing mechanism of a typewriter, a correction tape having an end which is fixed to the dispensing core and is wound around the dispensing core, and a spool onto which the free end of the correction tape is fixed. The used portion of the correction tape is wound around the spool which is set onto a winding mechanism of the typewriter.

However, it was recently found that such correction tapes can be used several times, and therefore, a reversible-type correction tape assembly has been proposed to enable re-use of the correction tape without change of the construction of conventional typewriters. For example, U.S. Pat. No. 4,518,128 discloses a reversible-type correction tape assembly comprising a correction tape; a dispensing core; a winding core which has the same shape and size as the dispensing core; a spool shaft capable of holding the winding core so that the winding core is not rotatable around the spool shaft and is slidable in the axial direction; and a cap detachably mounted to the top portion of the spool shaft for preventing slip-out of the winding core.

In the above-mentioned reversible-type correction tape assembly, the spool shaft and the cap may have screw means capable of engaging with each other, and the cap may be detachably fastened onto the top portion of the spool shaft by the screw means. Therefore, the two cores are exchangeable to each other, in order to remove the wound correction tape with the winding core from the winding mechanism and to re-set it on the dispensing mechanism of the typewriter.

However, in the above screw means, there is a disadvantage that the cap can automatically loosen and come off of the spool shaft when the correction tape is moved up in order to shift from an original lower position to an upper typing position, and as a result, the winding core slips out of the spool shaft.

The present invention is directed to eliminate the above disadvantage in the above-mentioned spool of the reversible-type correction tape assembly.

The main object of the present invention is to provide a spool for a reversible-type correction tape assembly, in which the cap is securely fastened onto the top portion of the spool shaft, but can be easily detached from the top portion of the spool shaft.

These and other objects of the present invention will become apparent from the description hereinafter).

SUMMARY OF THE INVENTION

In accordance with the present invention, there is provided a spool for a correction tape assembly comprising:

a spool shaft adapted to hold a winding core so that the winding core is slidable in an axial direction of the spool shaft, but is not rotatable around the axis of the spool shaft; the spool shaft having a top portion which has an engaging surface; and a cap detachably mounted on the top portion of the spool shaft so that the winding core does not slip off of the spool shaft; the cap having an engaging surface for engaging with the engaging surface of said spool shaft;

wherein one of the engaging surfaces of the cap and the spool shaft is provided with a projection extending in a radial direction, and the other is provided with a recess capable of engaging with the projection;

either the surface having the projection or the surface having the recess is in a form of a tongue-like plate or finger and is able to be resiliently bent in such direction that the engagement between the projection and the recess is released;

an engagement angle is provided between the contacting surfaces of the projection and the recess which engage each other when a cap-pulling force is applied in the axial direction along the spool shaft, so that the cap cannot be released even when the cap-pulling force is applied; and an engagement angle is provided between the contacting surfaces of the projection and the recess which engage each other when a cap-rotating force is applied around the spool shaft, so that the tongue-like plate can be resiliently bent by the cap-rotating force and the cap can be released.

The term "recess" is used herein to include any opening in one of the engaging surfaces, which opening receives the projection and has a surrounding wall surface which is engageable by the surface of the projection when the cap is engaged on the spool shaft, including a hole having a bottom, a perforated hole, and the like.

From the above construction, the engagement between the projection and the recess is not released by merely pulling up the cap in the axial direction, but can be released only by bending or flexing the tongue-like plate or finger when the cap and the spool shaft are relatively rotated in a predetermined torque.

That is to say, in the spool of the present invention, the engagement between the cap and the spool shaft does not become loose until the cap is twisted on the spool shaft in a particular direction and using a particular force. Therefore, the cap does not come off of the spool shaft by vibration occurring when the correction tape assembly shifts up or down, and the above-mentioned disadvantage of the conventional spool can be eliminated.

Furthermore, in the present invention, the operations of attachment and detachment of the core and the cap are very simple. That is to say, the engagement and disengagement can be easily carried out merely by rotating the cap a little to cause the tongue-like plate or finger to flex so that the projection moves out of the recess and the cap can be lifted off of the spool shaft.

DETAILED DESCRIPTION OF THE INVENTION

FIGS. 1 to 4 show the first embodiment of the spool of the present invention.

Figure 1:
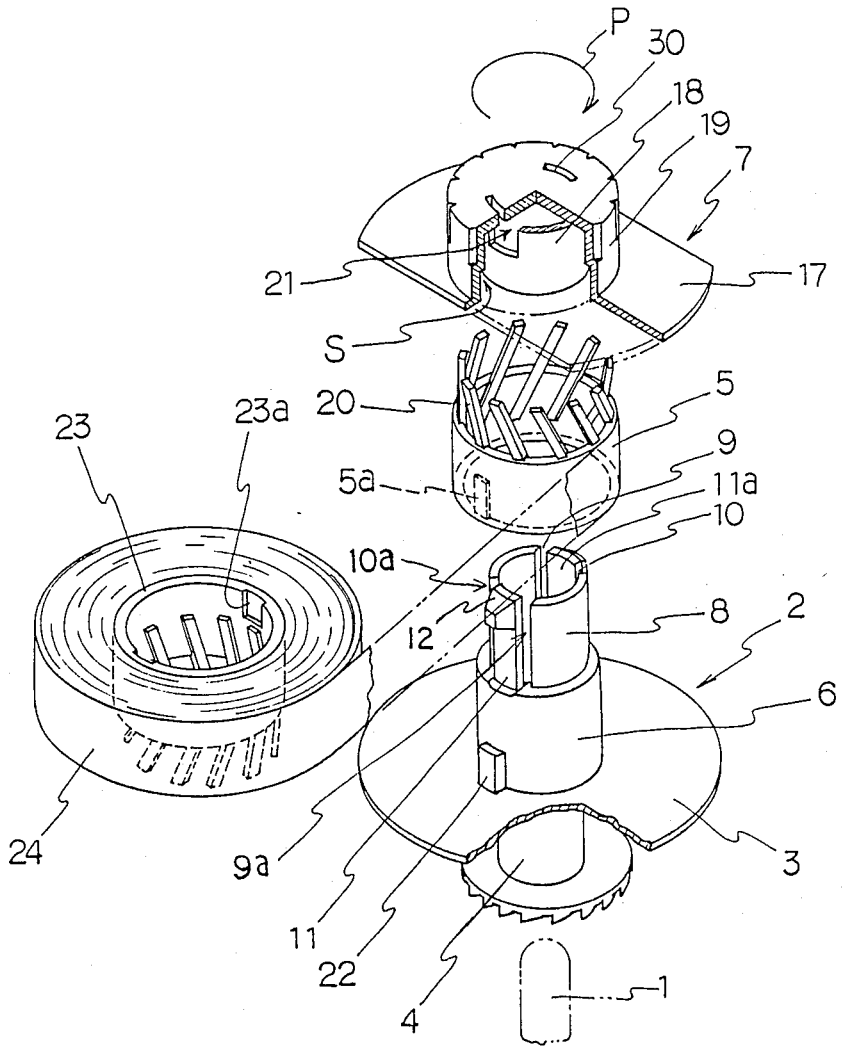
FIG. 1 is a partially cutaway and exploded perspective view of a reversible-type correction tape assembly including an embodiment of the spool of the present invention.
Figure 2:
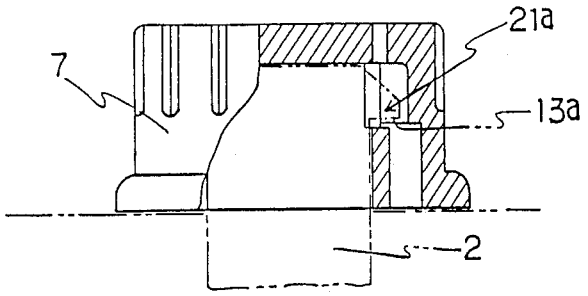
FIG. 2 is a partially cutaway elevational view showing the cap of FIG. 1.

In FIG. 1, the numeral 1 denotes a known supporting shaft which is rotatably supported by a lift stage (not shown in FIG. 1) mounted on a carrier of a conventional typewriter.

The numeral 2 denotes a spool shaft which has a tubular form in order to be rotatably supported on the supporting shaft 1. A disk-like flange 3 is integrated at the middle portion in the axial direction of the spool shaft. The flange 3 enables the even winding of the correction tape 24.

The spool shaft 2 is provided with an annular groove 4 at a position under the flange 3. The annular groove 4 is to be engaged with a known stopper arm (not shown in FIGS. 1 to 4) which is attached to the above-mentioned lift stage. Further, at a portion over the flange 3, the spool shaft 2 is provided with a core-engagement portion 6 for engaging a core 5 so that the core 5 cannot rotate around the spool shaft 2. A cap-engaging portion 8 having an outer peripheral surface as an engaging surface for engaging a cap 7 extends above the core engagement portion 6 of the spool shaft 2. In the case shown in FIGS. 1 to 4, the cap 7 has a hold 21 having an inner peripheral guide surface as an engaging surface. However, instead of the hole 21, a projection such as 12 having an outer peripheral surface as an engaging surface can be made at a lower surface of the cap 7, in which the projection 12 is inserted into a hole 21 having an inner guide surface as an engaging surface, which hole 21 is provided on the top portion of the spool shaft 2.

The cap-engaging portion 8 on the spool shaft 2 of FIG. 1 is divided by means of four slits 9, 9*a*, 10 and 10*a* into two arc-sections having relatively wider width and two tongue-like plates or fingers 11, 11*a*. The tongue-like plates 11, 11*a* can be resiliently bent of flexed in the radial directions. If necessary, the slits 9, 9*a*, 10 and 10*a* can be extended to the core-engaging portion 6.

The tongue-like plates 11, 11*a* are respectively provided with integrated projections 12, 12*a* on the upper outer surface, i.e. on the outer peripheral guide surface, of the cap-engaging portion 8.

Figure 3:
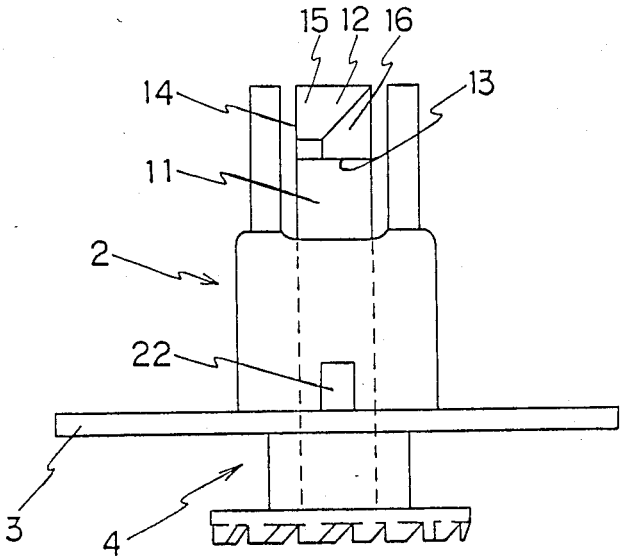
FIG. 3 is an elevational view showing the spool shaft of FIG. 1.
Figure 4:
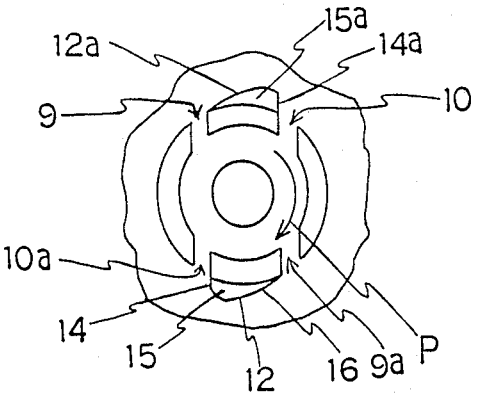
FIG. 4 is a partial plan view showing the spool shaft of FIG. 1.

As shown in detail in FIGS. 3 and 4, each projection 12, 12*a* is formed in the shape of a truncated pyramid having a lower surface 13, 13*a* which is approximately perpendicular with the axis of the spool shaft 2, one side surface 14, 14*a* which is approximately parallel with a radial plane including the axis of the spool shaft 2, upper surface 15, 15*a* which is inclined or tapered and the side surface 16, 16*a* which is also gently inclined or tapered.

The upper surfaces 15, 15*a* are guides for bending the tongue-like plates 11, 11*a* in the radial and inward direction when the core 5 and the cap 7 are attached to the spool shaft 2 in order to enable easy insertion.

The slope angle or taper of the side surface 16, 16*a* is designed so that the friction force between the side surface 16, 16*a* and the inner peripheral wall of surface 18 adjacent hole 21, 21*a* is greater than the friction force between the engaging surfaces of the cap 7 and the spool shaft 2.

The above-mentioned cap 7 has an integral rectangle-shaped flange 17 on the out side thereof, and the inside of the cap 7 is formed as a double-pipe shape for providing a cylindrical space S between an inner pipe portion 18 and an outer pipe portion 19. The space S is provided for receiving a set of helical claws 20 which are extending from an end of the core 5. The set of helical claws 20 has been known as a means for making a back-tension when a core is set as a dispensing core 23 to a dispensing mechanism of a typewriter. On the inner surface of the inner pipe portion 18, i.e. one of engaging surfaces, two rectangular holes 21, 21*a* are formed as recesses for receiving the projections 12, 12*a*.

As described above, the engaging angle between the side surface 16, 16*a* of the projection 12, 12*a* and the inner side surface of the hole 21, 21*a* facing to the side surface 16, 16*a* is out of an extent of repose angle. That is to say, the side surfaces 16, 16*a* are made as gentle slopes. Therefore, when the cap 7 is rotated a little in the direction of arrow P of FIG. 4 and the tapered surfaces 16, 16*a* of the projections 12, 12*a* contact the portions of surface 18 adjacent the holes 21, 21*a*, the projections 12, 12*a* move to the inner side of the inner pipe portions 18 and inwardly flex the tongue-like plates 11, 11*a*, respectively.

As a result, the engagements between the projections 12, 12*a* and the holes 21, 21*a* are released at the same time, and the cap 7 is freed and can be upwardly pulled freely.

Furthermore, the engaging angle between the lower surface 13, 13*a* of the projection 12, 12*a* and the opposed surface of the wall 18 at hole 21, 21*a* is a steep angle. Therefore, when the cap 7 is pulled upwardly, the tongue-like plate 11, 11*a* cannot be bent inwardly, and the cap 7 cannot be pulled out of the spool shaft 2. Further, even if the cap 7 is rotated in the direction inverse to the direction shown by arrow P of FIG. 1, the engagements between the projections 12, 12*a* and the holes 21, 21*a* cannot be released.

In FIG. 1, the numeral 22 denotes a key-like projection. The key-like projection 22 is to be inserted into the groove 5*a* or 23*a* which are provided in the inner surface of the core 5 or 23 in order to prevent the relative rotation between the core 5, 23 and the spool shaft 2. The arc-shaped perforations 30 are provided only for enabling an injection molding by means of a simple die or dies.

When a new correction tape assembly is set to a typewriter, a new correction tape 24 is wound around the dispensing core 23. After the correction tape 24 is used once and wound around the winding core 5, the cores 5, 23 are exchanged for each other. In case of the correction tape assembly shown in FIG. 1, the cores 5, 23 are inverted when they are exchanged. After the exchanging, the used correction tape assembly can be further used as it is.

As described above, though a preferable embodiment of the spool of the invention has been explained, however it is to be understood that the spool of the invention is not limited to the extent of the above-mentioned embodiment, but various modifications may be made in the invention without departing from the spirit and scope thereof. For example, hereinafter several modifications will be explained with reference to FIGS. 5 to 10.

Figure 5:
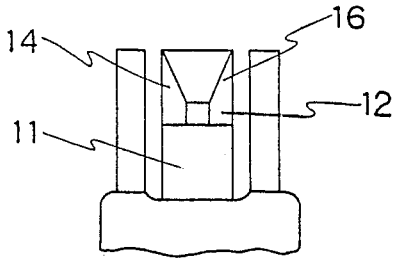
FIG. 5 is a partial elevational view showing another embodiment of a projection in the present invention.
Figure 6:
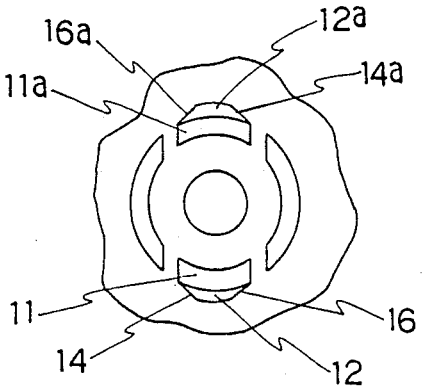
FIG. 6 is a partial plan view showing the projection of FIG. 5.

FIGS. 5 and 6 show an important part of the second embodiment of the spool in the present invention.

The projections 12, 12*a* of the tongue-like plates 11, 11*a* have side surfaces 14, 16 14*a*, 16*a* each of which is formed as a gentle slope or taper. In the second embodiment of the spool, the engagements between the projections 12, 12*a* and the holes (not shown in FIGS. 5 and 6) can be released by rotating the cap in either direction, since the tongue-like plates 11, 11*a* can be bent or flexed by contact of side surfaces 14, 14*a* or side surfaces 16, 16*a*.

Figure 7:
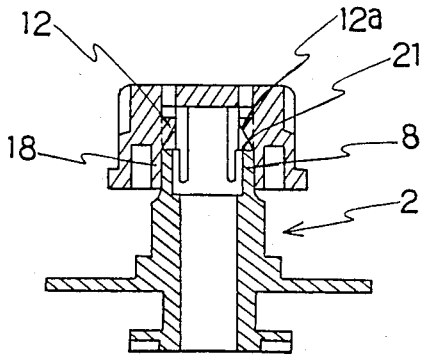
FIG. 7 is a longitudinal sectional view showing another embodiment of the spool of the present invention.

FIG. 7 shows the third embodiment of the spool of the present invention.

As shown in FIG. 7, projections 12, 12*a* can be provided on the inner peripheral guide surface of the inner pipe portion 18 of the cap. In that case, the projections 12, 12*a* are turned up to down relative to the case shown in FIGS. 1 to 4, and holes 21 are perforated in the corresponding positions of the tongue-like plates 11, 11*a* of the cap-engaging portion 8 of the spool shaft 2. Further, the tongue-like plates can be formed in the pipe section 18 of the cap 7.

That is to say, since the cap 7 and the spool shaft 2 in the present invention are only relatively engaged or disengaged, the characteristic functions and advantages of the present invention can be obtained even if the inverse construction is employed as described above.

Figure 8:
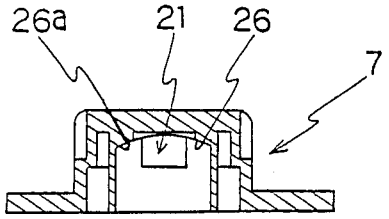
FIG. 8 is a longitudinal sectional view showing another embodiment of a cap in the present invention.
Figure 9:
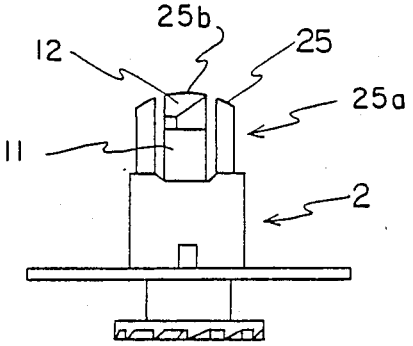
FIG. 9 is an elevational view of another embodiment of a spool shaft to be engaged with the cap of FIG. 8.
Figure 10:
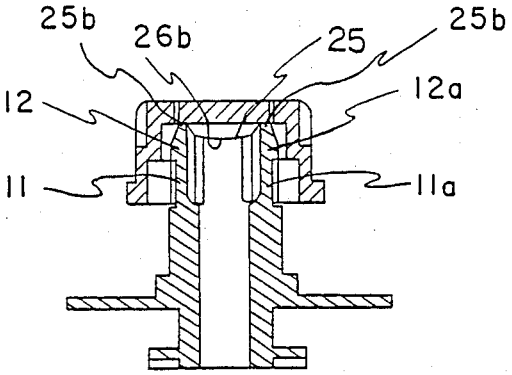
FIG. 10 is a longitudinal sectional view of the spool of the present invention which is a combination of the cap of FIG. 8 and the spool shaft of FIG. 9.

FIGS. 8 to 10 show the fourth embodiment of the spool of the invention.

In the fourth embodiment, as shown in FIG. 9, a cam surface 25 is formed on the top surface of the cap-engaging sleeve 25*a* of the spool shaft 2.

The cam surface 25 has a smoothly curved profile like a sine curve, for example. The curve ascends at the maximum height portions 25*b* comprised of the uppermost surface of tongue-like plates 11, 11*a* and descends at the other portions thereof.

As shown in FIG. 8, at the inner bottom surface of the cap 7, there is formed a curved projecting cam follower 26. The profiles of the cam 25 and the cam follower 26 are complementary to each other, i.e., follower 26 ascends to a maximum height 26*a* in areas away from the recess 21.

The fourth embodiment of the spool shown in FIGS. 8 to 10 has an advantage that when the cap 7 is rotated relative to the spool shaft 2 to the position in which ascending portions are abutted, the cap 7 comes automatically out of the cap-engaging portion of the spool shaft 2, after the engagements between the projection 11, 11*a* and hole 21, 21*a* are released.

The number of the sets of projections and recesses is not limited in the present invention. Though the above-described embodiments employ two sets of projections and recesses, one set as well as three or more sets can be also employed in the spool of the present invention.

What is claimed is:

1. A spool for a correction tape assembly having a correction tape-winding core, said spool comprising:

a spool shaft designed to releasably hold a winding core axially slideable and relatively nonrotatable thereon; said spool shaft comprising a sleeve having a lower core-receiving section and a top cap-receiving section having an outer cap-engaging surface; and a cap releasably secured to the cap-receiving section of said sleeve and designed to confine a said winding core on the core-receiving section of said sleeve; said cap having a depending wall having an inner shaft-engaging surface which engages the outer cap engaging surface of said spool shaft when said cap is secured to said sleeve;

wherein the engaging surface of either said cap or of said spool shaft is provided with a projection extending in a radial direction, and the other engaging surface is provided with a recess which receives and engages said projection when said cap is secured to said sleeve;

a portion of the engaging surface provided with said projection or a portion of said engaging surface provided with said recess comprising a tongue-like flexible plate or finger;

said projection having at least one flat surface which contacts a wall surface of said recess in the axial direction along said spool shaft, so that said cap cannot be released when an axial cap-pulling force is applied; and said projection having at least one tapered side surface which is inclined towards a side wall surface of said recess, whereby when a cap-rotating force is applied around said shaft said tapered side surface contacts said side wall surface and said tongue-like plate or finger is resiliently bent or flexed to cause said projection to move out of said recess and permit said cap to be removed from said shaft.

2. A spool according to claim 1 in which said projection is present on said spool shaft and said recess is present on said cap.

3. A spool according to claim 1 in which said projection is present on said tongue-like plate or finger.

4. A spool according to claim 1 in which said tongue-like plate or finger comprises a section of the engaging surface of the cap-receiving section of the spool shaft.

5. A spool according to claim 4 in which the uppermost surface of the cap-receiving section of the spool shaft comprises a cap-engaging cam surface having a maximum height in the area thereof comprising said tongue-like plate or finger, and the inner surface of the cap engaged by said cam surface comprises a curved cam follower having a maximum height in the area thereof which is out of contact with said tongue-like plate or finger when the cap is fastened to said spool shaft, whereby when said cap is twisted to release the projection from the recess the contact between the maximum height areas of the cam surface and the cam follower pushes the cap axially of said spool shaft.

6. A spool according to claim 1 in which said cap has a double pipe wall in which the innermost pipe section comprises said depending wall having said inner-shaft-engaging surface, and an annular space between said pipe sections which is designed to receive the helical claw section of a conventional correction tape-winding core when a said core is mounted on said spool shaft.

7. A spool according to claim 1 in which said spool shaft comprises a projection on said core-engaging section designed to be received within a slot in a said winding core to prevent relative rotation therebetween.

8. A spool according to claim 1 in which said core-receiving section of the shaft also comprises a radially-extending base flange designed to support a said winding core on the spool shaft and to enable the even winding of correction tape on said core.

9. A spool according to claim 1 in which said cap also comprises a lower radially-extending flange.

10. A spool according to claim 1 in which said projection has a tapered upper surface which is designed to contact an opposed engaging surface of the cap during application of the cap, to cause flexing of said tongue-like plate or finger and permit said cap to be pushed onto the spool shaft until said projection enters said recess.

* * * * *